US007637138B2

(12) United States Patent
Hafner

(10) Patent No.: US 7,637,138 B2
(45) Date of Patent: Dec. 29, 2009

(54) MULTISTAGE PRESS

(75) Inventor: Josef Thomas Hafner, Rorschacherberg (CH)

(73) Assignee: Bruderer AG, Frasnacht (CH)

( * ) Notice: Subject to any disclaimer, the term of this patent is extended or adjusted under 35 U.S.C. 154(b) by 554 days.

(21) Appl. No.: 11/252,208

(22) Filed: Oct. 17, 2005

(65) Prior Publication Data

US 2006/0101892 A1 May 18, 2006

(30) Foreign Application Priority Data

Nov. 17, 2004 (EP) ..... 04027235

(51) Int. Cl.
*B21J 9/18* (2006.01)
*B30B 1/26* (2006.01)
*B21D 22/28* (2006.01)

(52) U.S. Cl. ..... 72/452.4; 72/452.6; 72/452.7; 100/259; 100/282; 100/291; 100/292; 83/615; 83/628

(58) Field of Classification Search ..... 72/452.4, 72/452.6, 452.7; 100/259, 282, 291, 292; 83/615, 628
See application file for complete search history.

(56) References Cited

U.S. PATENT DOCUMENTS 4,238,950 A 12/1980 Carrieri et al.
4,587,826 A 5/1986 Bulso, Jr. et al.
4,638,731 A * 1/1987 Kato ..... 100/282
4,741,196 A 5/1988 Stewart et al.
4,881,397 A 11/1989 Stewart et al.
4,945,742 A 8/1990 Schoch
4,955,223 A 9/1990 Stodd et al.
4,966,028 A 10/1990 Sakamura et al.
5,317,893 A 6/1994 Eigenmann et al.
5,428,982 A 7/1995 Hinterlechner et al.
5,544,576 A * 8/1996 Kato ..... 100/259
5,566,373 A 10/1996 Seimetz et al.
5,605,096 A * 2/1997 Kato ..... 100/292
5,687,645 A * 11/1997 Kato ..... 72/452.6
5,852,970 A 12/1998 Bornhorst et al.
5,857,374 A 1/1999 Stodd
5,996,392 A * 12/1999 Garth ..... 72/452.4
6,000,322 A 12/1999 To (Continued)

FOREIGN PATENT DOCUMENTS

DE 40 28 920 3/1991

(Continued)

OTHER PUBLICATIONS

English Abstract of DE 40 28 920 dated Mar. 14, 1991.

(Continued)

*Primary Examiner*—David B Jones
(74) *Attorney, Agent, or Firm*—Ladas and Parry LLP

(57) ABSTRACT

The invention concerns a multistage press, at which within the machine-mounted clamping plate (1), an insert (3) is arranged which can alternatingly be moved in the direction towards the press plunger (2) and away from it. The insert (3) is moved up and down by a cam drive actuated by the press main drive with lifting and lowering cams (5), whose cam tracks (8*a*, 8*b*) are traced by lifting rollers (6) and lowering rollers (7) under compressive prestress.

Such a multistage press can be operated with a high number of strokes per minute and has, at the same time, an excellent precision of the stroke movement.

23 Claims, 6 Drawing Sheets

U.S. PATENT DOCUMENTS

| | | | | |
|---|---|---|---|---|
| 6,477,945 | B1 | 11/2002 | Imanishi et al. | |
| 6,619,097 | B1 * | 9/2003 | Garth | 72/452.7 |
| 6,990,898 | B2 * | 1/2006 | Kato | 72/452.6 |
| 2002/0035881 | A1 | 3/2002 | Kato | |

FOREIGN PATENT DOCUMENTS

| | | |
|---|---|---|
| DE | 196 49 198 | 3/1997 |
| DE | 199 63 063 | 7/2001 |
| EP | 0 224 096 | 6/1987 |
| GB | 2 230 219 | 10/1990 |
| GB | 2 307 435 | 5/1997 |
| JP | 58-53395 | 3/1983 |
| JP | 2-41800 | 2/1990 |
| JP | 2-59197 | 2/1990 |
| JP | 4-111995 | 4/1992 |
| JP | 6-170590 | 6/1994 |
| JP | 2000-140952 | 5/2000 |
| JP | 2002-5256 | 1/2002 |
| RU | 2 043 928 | 9/1995 |

OTHER PUBLICATIONS

English Abstract of Espacenet-Database of DE 199 63 063 dated Jul. 12, 2001.
English Abstract of Espacenet-Database of JP 58-533395 dated Mar. 29, 1983.
English translation of JP 2000-140952 dated May 23, 2000.
English abstract of JP 4-111995 dated Apr. 13, 1992.
English abstract of JP 2-59197 dated Feb. 28, 1990.
Bruderer Leading technology for punching techniques / High performance automatic punching press BSTA 125 Product Brochure.
Bruderer Leading technology for punching techniques / High performance automatic punching press BSTA 500 Product Brochure.
English abstract of JP 2-41800 dated Feb. 9, 1990.
English abstract of JP 6-170590 dated Jun. 21, 1994.
English abstract of RU 2043928 dated Sep. 20, 1995.
English abstract of EP 0244096 dated Jun. 3, 1987.
English abstract of JP 2002-5256 dated Jan. 9, 2002.

* cited by examiner

MULTISTAGE PRESS

BACKGROUND OF THE INVENTION

This invention concerns a multistage press and the use of the press for the fabrication of lids for beverage cans. Such presses are of the type including a machine-mounted claiming plate and a press plunger located opposite the clamping plate and in operation pressing lid blanks against the clamping plate.

For the industrial fabrication of beverage can lids, multistage presses are predominantly used in which, in addition to the upward and downward movement of the press plunger, forming tool elements travel towards and away from said plunger. In multistage presses used at present, this movement is produced in such a way that the moveable tool elements are coupled with the plunger drive by way of crank or cam drives or by means of lever or tie rod arrangements. However, all known multistage presses have the disadvantage that they can only be driven with a relatively low number of strokes per minutes and the precision of movement declines rapidly with the increasing number of strokes.

This task is solved by the multistage press according to present invention.

BRIEF SUMMARY OF THE INVENTION

This task is solved by the multistage press according to patent claim 1.

Accordingly, a first aspect of the invention provides a multistage press with a machine-mounted clamping plate and a press plunger located opposite the clamping plate and working to push lid blanks against said clamping plate. Within the clamping plate, an insert is arranged that serves the purpose of receiving a tool and which is connected with driving means, e.g. with a servo motor or an universal-joint shaft driven by the press drive, in such a way that, depending on a movement of the press plunger, it is alternately moveable in the direction towards the press plunger and away from it. The insert and the drive means are positively connected with each other in both directions of movement, which is accomplished by coupling means arranged between them that convert the revolving rotational drive movement of the driving means into the upward and downward movement of the insert by tracing a rotating guiding surface.

Separate followers, which are movably guided by the rotating guiding surface are provided for both directions of movement, e.g. for the upward as well as for the downward movement. By this it is possible to provide multistage presses which can be operated with a high number of strokes and which, at the same time, provide an excellent precision of movement.

In a preferred embodiment of the multistage press, the shape tracing means for both movement directions are prestressed against each other so that they trace the shape of the at least one guiding surface under prestress. By this it becomes possible to carry out the con-version of the rotary drive movement into the upward and downward movement in a play-free manner, through which the precision can further be improved.

A separate guiding surface may preferably be provided for each of the two movement directions to provide asymmetrical movement sequences of the insert.

For the tracing for the movement in the direction of the insert towards the press plunger, more followers may be provided than for the tracing for the movement in the direction away from the press plunger because the first-mentioned movement, in which typically deformation or cutting work is performed, can take place under significantly higher load than the latter-mentioned movement.

In another embodiment of the multistage press, the at least one guiding surface is formed by a cam or a cam disk, wherein the followers are cam following rollers. In this way, major forces can be transmitted in a simple manner.

It is a further advantage in this case if the shape tracing rollers for both movement directions are mounted in a common structural element because, in this way, additional clearances are avoided and it is moreover possible in an easy manner to prestress the shape tracing rollers of the two movement directions against each other, for example by coupling their bearing locations together by means of straining screws.

If the cam following rollers are mounted on a common lever, namely preferably near one end of the lever, wherein the lever is mounted in the press frame and is connected with the insert in such a way that a force provided by one of the shape tracing rollers is transmitted to the insert with a transmission ratio of greater than one, very large lifting forces can be provided at the insert.

Preferably, the position of the bearing of the common lever in the press frame can be adjusted so that it is possible to compensate for manufacturing tolerances.

In yet a further preferred embodiment of the multistage press, the insert has a longitudinal extension in the direction of material flow of the press amounting to at least half, preferably two thirds of the longitudinal extension of the clamping plate. By this, there is the possibility of arranging several identical tools on the insert and, subsequently, to manufacture a corresponding number of products per press stroke.

Preferably, the insert is plate-shaped, preferably substantially rectangular, so that, as far as possible, it can be universally fitted with tools and, at the same time, forms a sturdy structure.

In yet a further preferred embodiment of the multistage press, the rotation axis of the structural element of the coupling means, which provides the at least one revolving guiding surface, and subsequently also the rotation axis of this guiding surface, is arranged parallel to the direction of material flow of the press, by which it becomes possible to arrange several coupling configurations with guiding surfaces and shape tracing means along one single shafting in the direction of material flow and thereby connect them play-free with one another.

At yet a further preferred embodiment, the insert is guided in a linear manner by guiding means which, at embodiments with shape tracing rollers mounted in a common lever, is by advantage accomplished in that the guiding means have at least one guide column guided in an upper and in a lower linear bearing, and the lever engages the guide column in the area between both linear bearings. A particularly sturdy structure is obtained in this way.

If the multistage press has several identical coupling means or configurations, respectively, with guiding surfaces and shape tracing means, such as for example several cam sections which, seen over the extension of the insert, are arranged at several locations, preferably at exactly two locations and by advantage in the direction of material flow of the press in successive order, and are connected with the insert, also relatively long inserts can be realised without encountering the danger of a chocking.

If all elements of the coupling means, which are required for the conversion of the rotatoric drive movement into the movement of the insert, are integrated in the machine bed, which is preferred, a compact structural design with a minimum of externally located and moving parts is obtained as a result so that the danger of injury can be reduced and, in addition, the moving parts are protected against dirt and damage.

As driving means for providing for the rotatoric drive movement for the coupling means, preferably an universal-joint shaft connected with the press drive or a servo motor is present, wherein the first-mentioned variant has the advantage of a mechanically synchronised coupling and the latter-mentioned the advantage of an uncomplicated adaptation to existing production plants.

If the universal-joint shaft or the servo motor is coupled by way of a reduction gear with the structural component providing the at least one guiding surface, the torque at the universal-joint shaft or at the servo motor is reduced, whereby the torsion stress of the participating structural components can be reduced.

A second aspect of the invention concerns the use of the multistage press in accordance with the first aspect of the invention presented above for the manufacture of lids for beverage cans. With such a use, the advantages of the invention are particularly evident.

Further preferred embodiments of the invention result from the dependent claims and from the following description based on the Figures. Therein shows:

DETAILED DESCRIPTION OF THE INVENTION

Figure 1A:
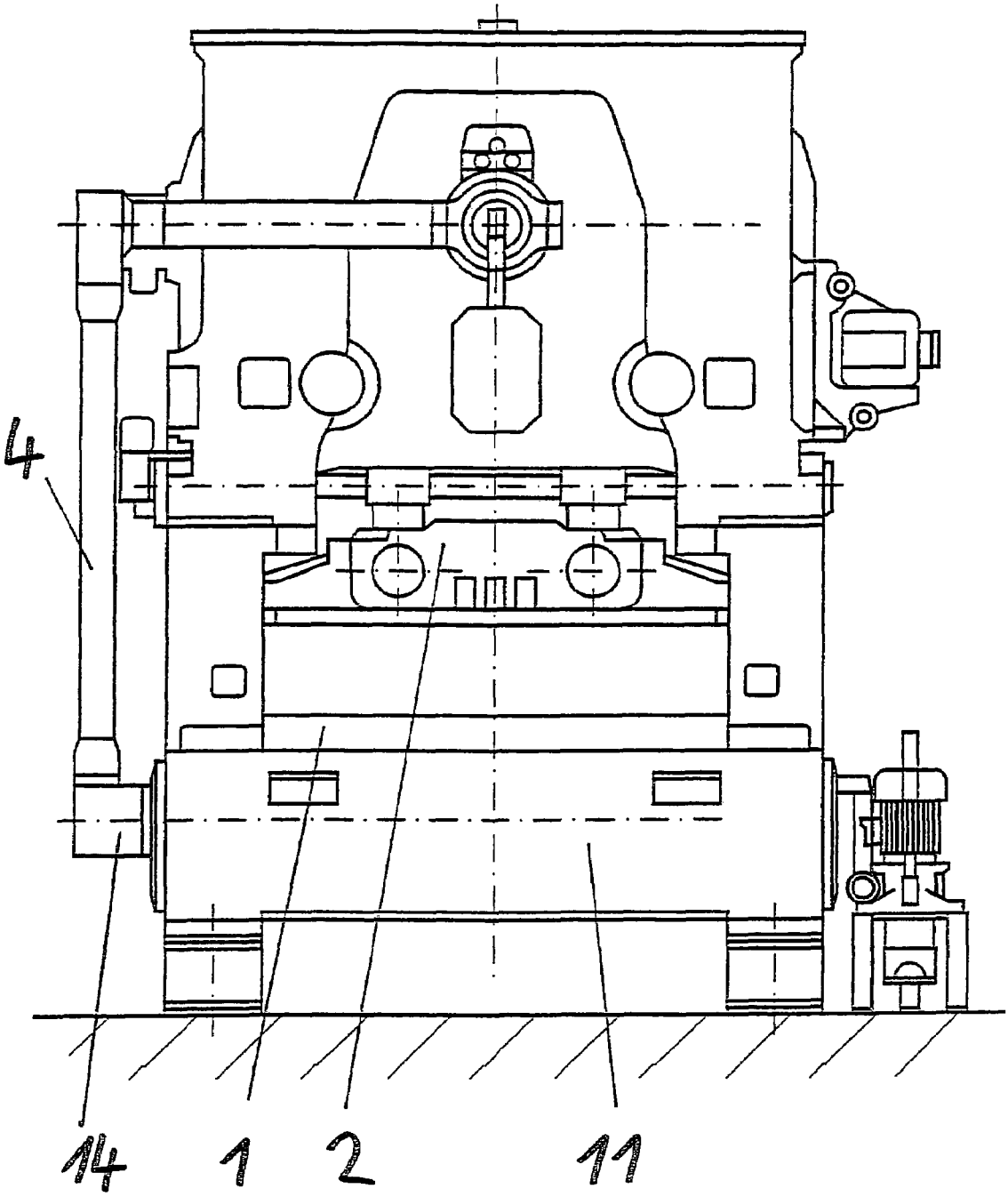
FIG. 1*a*: a front view of a first multistage press according to the invention.
Figure 1B:
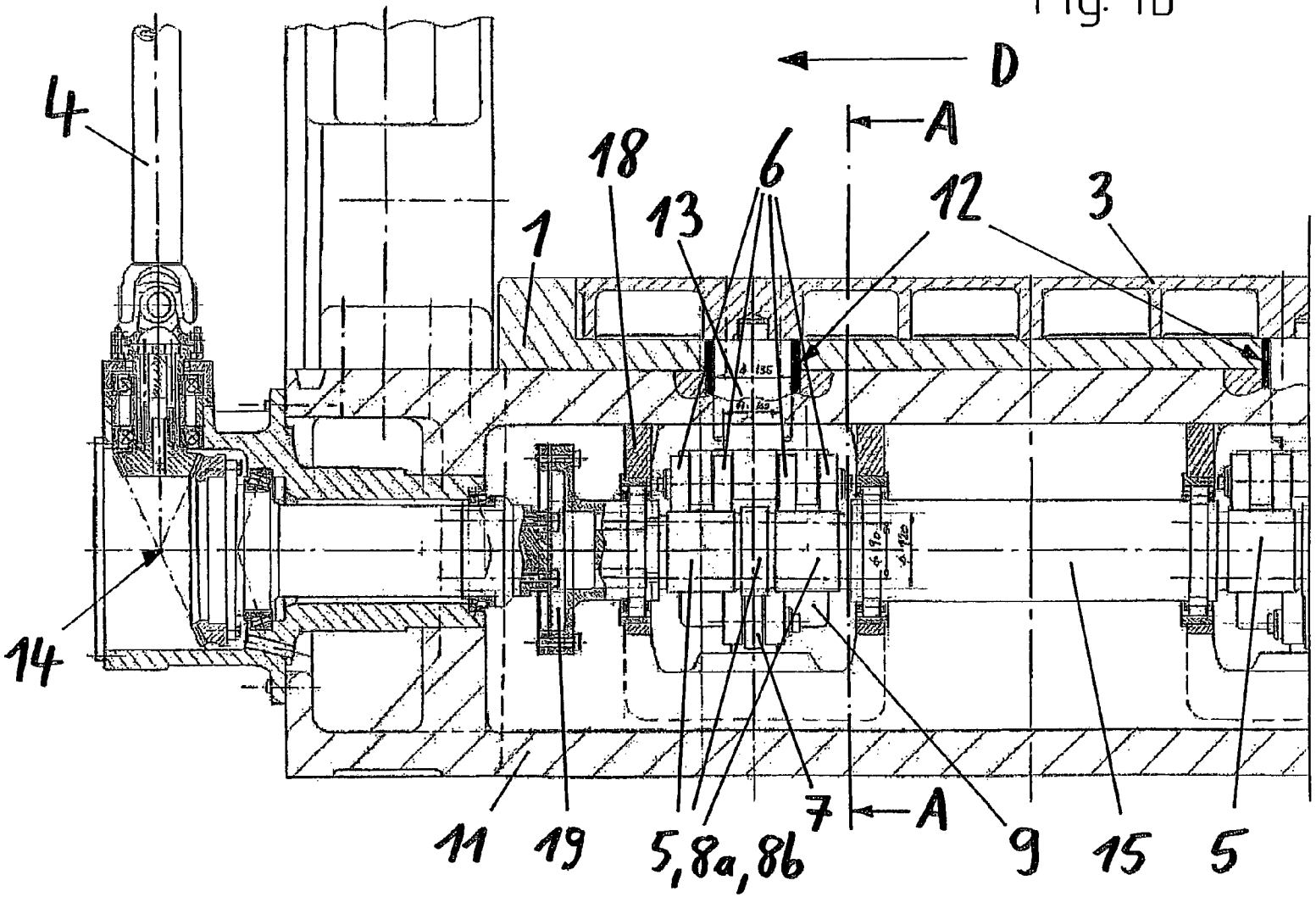
FIG. 1*b*: a vertical cross-section in the direction of material flow of the press through the machine bed of the press from FIG. 1*a;*
Figure 1C:
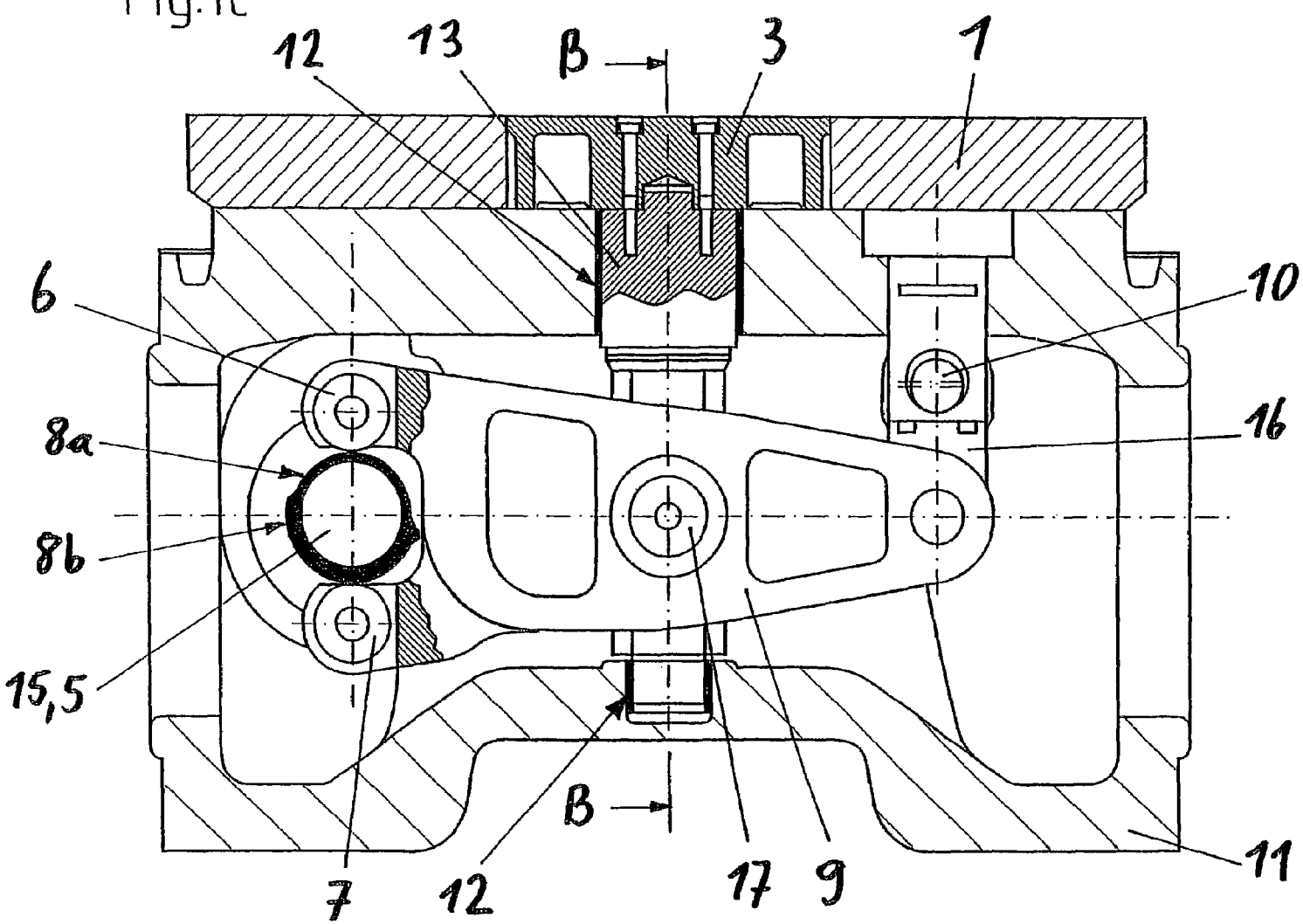
FIG. 1*c*: a vertical cross-section through the machine bed of the press from FIG. 1*a* along the line A-A in FIG. 1*b;*
Figure 1D:
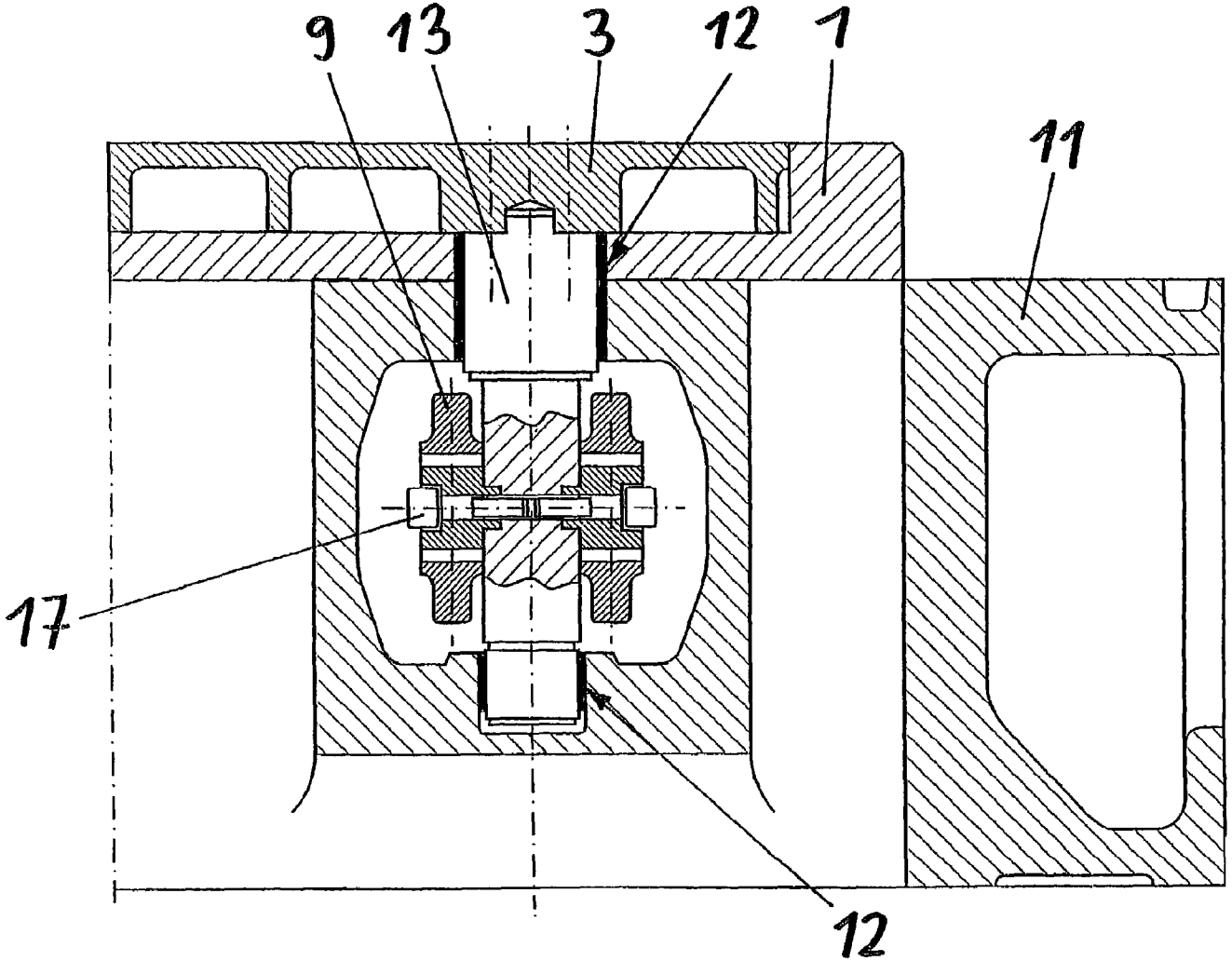
FIG. 1*d*: a cross-section along the line B-B in FIG. 1*c;*

The basic structural design of a first multistage press according to the invention is shown in FIGS. 1*a* to 1*d*, which show a front view of the press as well as various cross-sections through the machine bed 11 of the press. As can be seen, the press has a press plunger 2 which can be intermittently moved up and down with the press drive (not shown) for performing punching and/or deforming work with a tool (not shown) which is secured thereto. Opposite the plunger 2, a machine-mounted clamping plate 1 is arranged within which an insert plate 3 is arranged. The insert plate 3 is guided in a vertical sliding manner in the machine bed 11 by means of two guide columns 13, each of which is guided in upper and lower linear bearings 12, and can, depending on a movement of the plunger 2, be moved towards and away from it for the purpose of producing a movement superimposed on the plunger movement of tool elements (not shown) secured on the insert plate 3. Here, the driving of the insert plate 3 is effected in such a way that, by way of an universal-joint shaft 4, drive energy is made available from the press main motor which is then supplied by way of an angular reduction gear 14 and a torsion-proof metal disk coupling 19 to a cam shaft 15 running parallel to the direction of material flow D of the press, whose cams 5 move back and forth levers 9 connected with the insert 3, and by doing so, lift and lower the insert 3. The camshaft 15 is supported in the machine bed 11 in several bearings 18 designed in each case as exchangeable units, and has each two cam sections which consist in each case of two wider lifting cams 5 and a narrower lowering cam 5 arranged therebetween. The cam track 8*a* of each lifting cam 5 is traced by two lifting rollers 6, whereas the cam track 8*b* of the lowering cam 5 is traced by one single lowering roller 7. Here, the lifting and lowering rollers 6, 7 of each cam section are mounted at one end of a lever 9 and are prestressed against each other so that they trace the shape of the cam tracks 8*a*, 8*b* under prestress. At the other end, the lever 9 is hinged by means of a shackle 16 to a machine-mounted swivel joint 10, which is arranged as a dismountable insert in the machine bed 11 and whose position can be adjusted by means of an eccentric. Between its two ends, the lever 9 is coupled with the associated guide column 13 by way of pins 17, so that the tilting movement executed by the lever 9 during the tracing of the shape of the guide tracks 8*a*, 8*b* is converted into a purely translatory up and down movement of the guide column 13 and the insert plate 3 supported by this.

Figure 2:
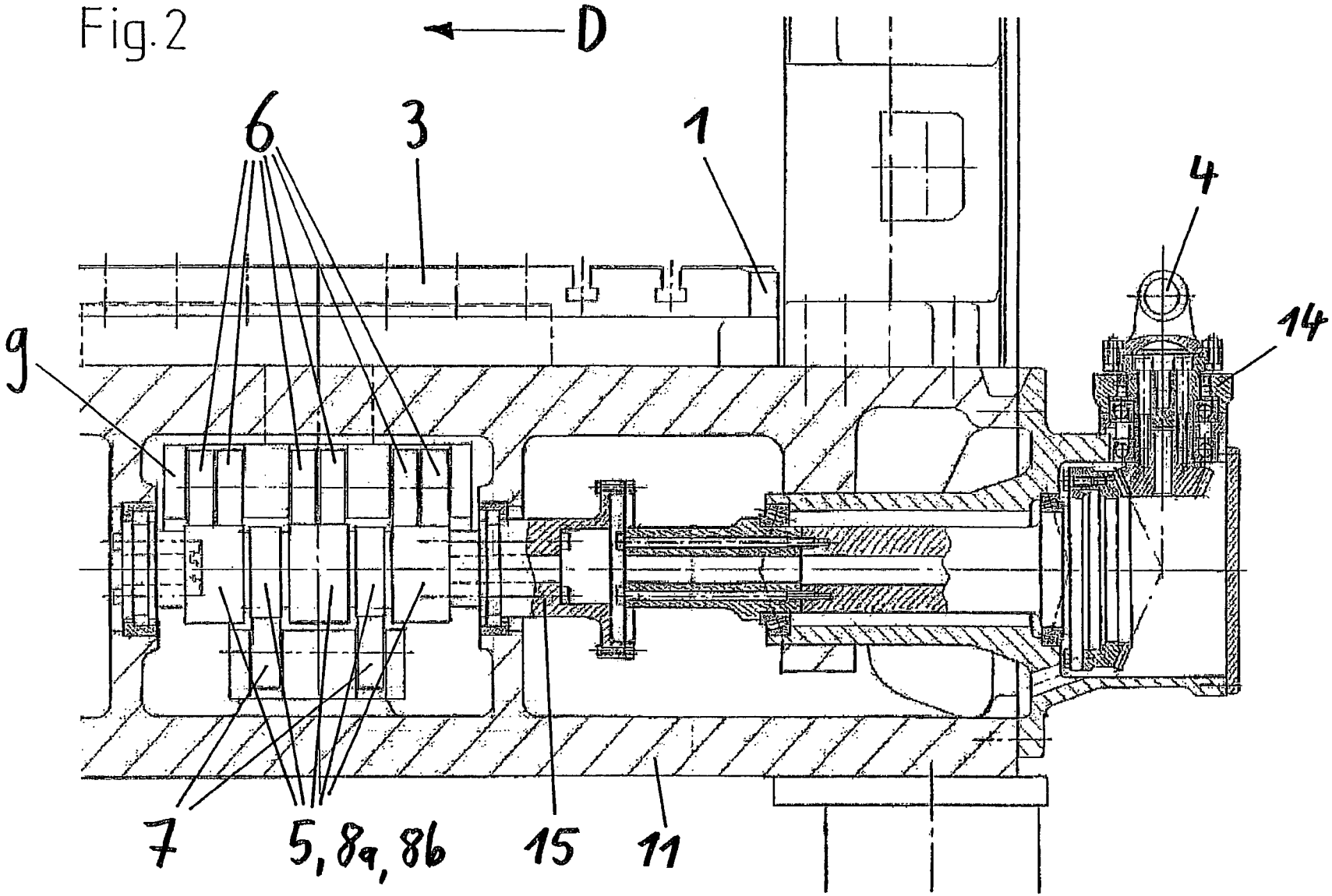
FIG. 2: a cross-section as FIG. 1*b* through a second multistage press according to the invention.

FIG. 2 shows a vertical cross-section in the direction of the material flow D through the machine bed 11 of a second multistage press according to the invention, which differs from that shown in FIG. 1 essentially in that while only one cam section arranged centrally in the machine bed 11 is provided in the embodiment shown in FIG. 1, the embodiment of FIG. 2 has three lifting cams 5 and two lowering cams 5. The cam track 8*a* of each lifting cam 5 is traced by two lifting rollers 6 and the cam track 8*b* of each lowering cam 5 is traced by a single lowering roller 7.

Figure 3:
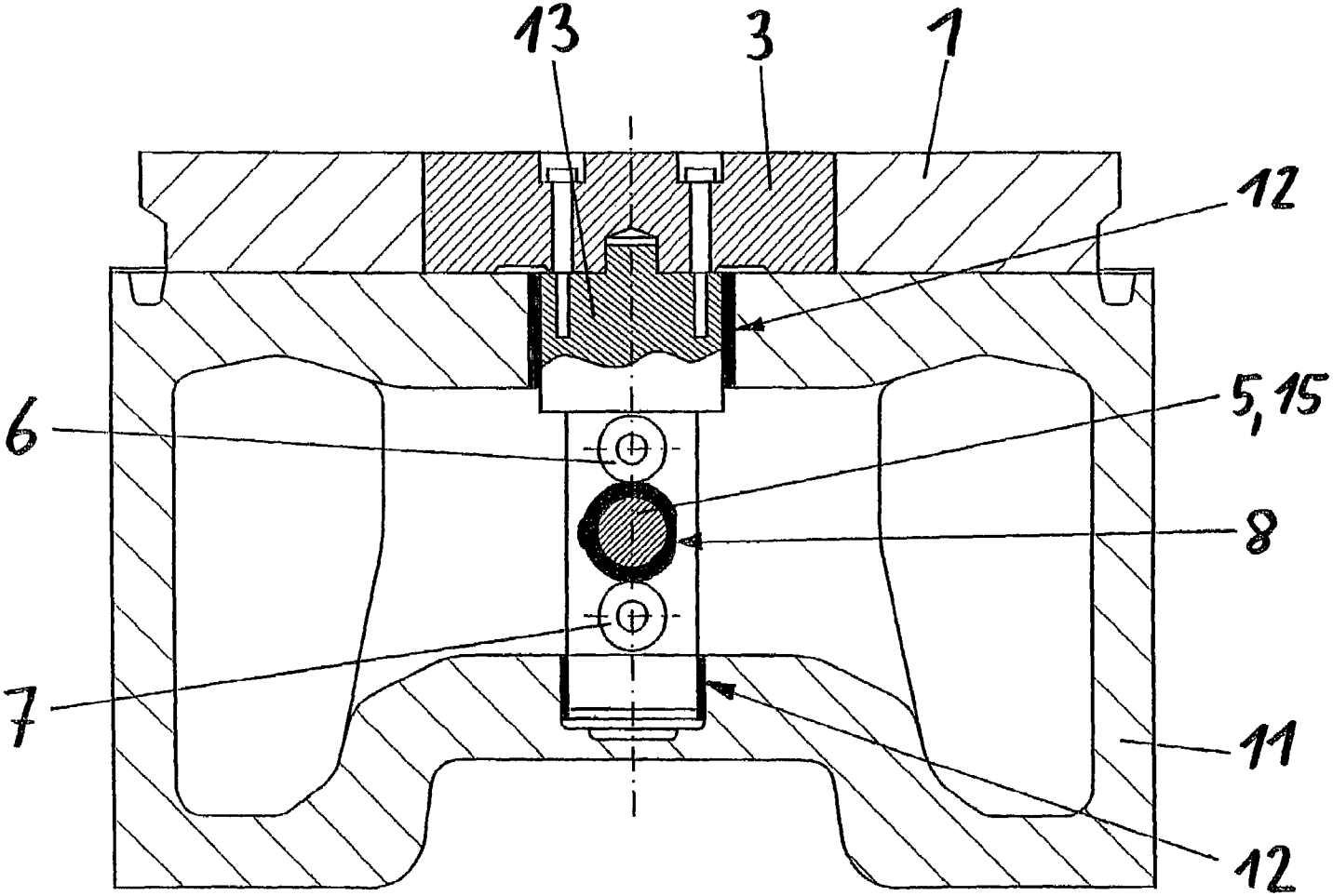
FIG. 3: a cross-section as FIG. 1*c* through a third multistage press according to the invention.

FIG. 3 shows a vertical cross-section transverse to the direction of material flow D through the machine bed 11 of a third multistage press according to the invention, which differs from the other two models previously shown essentially in that the lifting and lowering rollers 6, 7 are mounted directly in the guide column 13 and, consequently, a lever can be dispensed with. Furthermore, for each cam section, only one single cam 5 exists, whose cam track 8 is traced by the lifting roller 6 as well as by the lowering roller 7.

Even though in the present examples exclusively rollers 6, 7 are used as shape tracing means according to the claims, also the use of other shape tracing means, such as e.g. levers with sliding surfaces, is envisaged.

The invention claimed is:

1. A multistage press comprising:

a machine-mounted clamping plate;

a press plunger located opposite the clamping plate;

an insert arranged within the clamping plate;

drive means connected to the insert to move the insert alternately towards and away from the press plunger depending on a movement of the press plunger;

coupling means coupling the drive means to the insert for converting a rotational drive movement of the drive means into movements of the insert towards and away from the press plunger; the coupling means including a rotating guiding surface, and a plurality of followers including first and second followers movably guided by the rotating guiding surface;

wherein the first follower positively moves the insert towards the press plunger, and the second follower positively moves the insert away from the press plunger.

2. The multistage press according to claim 1, wherein the first and second followers are prestressed against each other so as to trace the shape of the guiding surface under prestress.

3. The multistage press according to claim 1, wherein separate guiding surfaces are provided for the movements of the insert towards and away from the press plunger.

4. The multistage press according to claim 1, wherein, for movement of the insert towards the press plunger, more followers are provided than for movement of the insert away from the press plunger.

5. The multistage press according to claim 1, wherein the guiding surface is formed by a cam or a cam disk.

6. The multistage press according to claim 5, wherein the followers are cam following rollers.

7. The multistage press according to claim 6, wherein the cam following rollers are mounted on a common structural component.

8. The multistage press according to claim 7, wherein the cam following rollers are mounted on a common lever, near one end of the lever, and wherein the lever is connected with a machine-mounted point of a machine bed and with the insert such that a force provided by the cam following rollers is transmitted to the insert with a transmission ratio of greater than one.

9. The multistage press according to claim 8, wherein the machine-mounted point is adjustable.

10. The multistage press according to claim 1, wherein the insert has a longitudinal extension in the direction of a material flow of the press which amounts to at least one half, in particular to at least two thirds, of the extension of the clamping plate in this direction.

11. The multistage press according to claim 1, wherein the insert is plate-shaped and is substantially rectangular.

12. The multistage press according to claim 1, wherein a rotation axis of the structural component of the coupling means, which provides the at least one revolving guiding surface, is arranged parallel to a direction of material flow of the press.

13. The multistage press according to claim 1, wherein the insert is guided in a linear manner by guiding means.

14. The multistage press according to claim 13, wherein the at least one guiding surface is formed by a cam or a cam disk and the followers are cam following rollers mounted on a common lever near one end of the lever, wherein the lever is connected with a machine-mounted point of a machine bed and with the insert such that a force provided by the cam following rollers is transmitted to the insert with a transmission ratio of greater than one and wherein the guiding means have at least one guide column guided in an upper and in a lower linear bearing and the lever is connected with the guide column in the area between the two linear bearings.

15. The multistage press according to claim 1, wherein the press has a plurality of the coupling means connected with the insert.

16. The multistage press according to claim 1, wherein the coupling means are integrated in a machine bed.

17. The multistage press according to claim 1, wherein, the coupling means includes an universal-joint shaft connected to the press drive or a servo motor.

18. The multistage press according to claim 17, wherein the universal-joint shaft or the servo motor is coupled through a reduction gear with the structural component providing the at least one guiding surface.

19. A method comprising providing the multistage press according to claim 1 and making lids for beverage cans with the multistage press.

20. A multistage press comprising:

a machine-mounted clamping plate;

a press plunger located opposite the clamping plate;

an insert arranged within the clamping plate;

drive means connected to the insert to move the insert alternately towards and away from the press plunger depending on a movement of the press plunger;

coupling means coupling the drive means to the insert for converting a rotational drive movement of the drive means into movements of the insert towards and away from the press plunger coupling means coupling the drive means to the insert for converting a rotational drive movement of the drive means into movements of the insert towards and away from the press plunger; the coupling means including a rotating guiding surface, and a plurality of followers including first and second followers movably guided by the rotating guiding surface;

wherein the first follower positively moves the insert towards the press plunger, and the second follower positively moves the insert away from the press plunger; and wherein the first and second followers are prestressed against each other so as to trace the shape of the guiding surface under prestress.

21. The multistage press according to claim 20, wherein, for movement of the insert towards the press plunger, more following means are provided than for movement of the insert away from the press plunger.

22. A multistage press comprising:

a machine-mounted clamping plate;

a press plunger located opposite the clamping plate;

an insert arranged within the clamping plate;

drive means connected to the insert to move the insert alternately towards and away from the press plunger depending on a movement of the press plunger;

coupling means coupling the drive means to the insert for converting a rotational drive movement of the drive means into movements of the insert towards and away from the press plunger; the coupling means including a rotating guiding surface, and a plurality of followers including first and second followers movably guided by the rotating guiding surface;

wherein the first follower positively moves the insert towards the press plunger, and the second follower positively moves the insert away from the press plunger;

wherein the guiding surface is formed by a cam or a cam disk;

wherein the followers are cam following rollers mounted on a common lever near one end of the lever; and wherein the lever is connected with a machine-mounted point of a machine bed and with the insert such that a force provided by the cam following rollers is transmitted to the insert with a transmission ratio of greater than one.

23. A multistage press comprising:

a machine-mounted clamping plate;

a press plunger located opposite the clamping plate;

an insert arranged within the clamping plate;

drive means connected to the insert to move the insert alternately towards and away from the press plunger depending on a movement of the press plunger;

coupling means coupling the drive means to the insert for converting a rotational drive movement of the drive means into movements of the insert towards and away from the press plunger; the coupling means including a rotating guiding surface, and a plurality of followers including first and second followers movably guided by the rotating guiding surface;

wherein the first follower positively moves the insert towards the press plunger, and the second follower positively moves the insert away from the press plunger;

wherein the first and second followers are prestressed against each other so as to trace the shape of the guiding surface under prestress;

wherein the guiding surface is formed by a cam or a cam disk;

wherein the followers are cam following rollers mounted on a common lever near one end of the lever;

wherein a rotation axis of a structural component of the coupling means which provides the rotating guiding surface is arranged parallel to a direction of material flow of the press; and wherein the press has a plurality of the coupling means connected to the insert.

* * * * *